US005474248A

United States Patent [19]

Bradshaw et al.

[11] Patent Number: 5,474,248

[45] Date of Patent: Dec. 12, 1995

[54] SLITTER/REWINDER MACHINE

[75] Inventors: Franklin C. Bradshaw; Terry G. Rutledge, both of Scottsdale, Ariz.

[73] Assignee: Product Search, Inc., Scottsdale, Ariz.

[21] Appl. No.: 106,438

[22] Filed: Aug. 16, 1993

[51] Int. Cl.[6] ..... B65H 18/10; B65H 23/06; B65H 21/00

[52] U.S. Cl. ..... 242/421.8; 242/525.7; 242/530.4; 242/534.2; 242/534.1; 242/556.1

[58] Field of Search ..... 242/421.8, 422.8, 242/525.5, 525.6, 525.7, 523.1, 530.4, 530.3, 534.2, 540, 545.1, 534.1, 556.1, 551, 552

[56] References Cited

U.S. PATENT DOCUMENTS

| | | | |
|---|---|---|---|
| 465,575 | 12/1891 | Inman et al. | 242/530.4 |
| 929,876 | 8/1909 | Pulsifer | 242/530.4 |
| 2,323,003 | 6/1943 | Baur | 242/525.7 |
| 2,698,359 | 12/1954 | Roberts | 242/530.4 |
| 3,228,624 | 1/1966 | Brinkman | 242/421.8 |
| 3,477,657 | 11/1969 | Norbisrath | 242/523 X |
| 4,094,474 | 6/1978 | Stollenwerk et al. | 242/525.5 |
| 4,958,111 | 9/1990 | Gago | 242/534.1 X |
| 5,154,786 | 10/1992 | Matsuyama | 242/556.1 X |

*Primary Examiner*—John M. Jillions
*Attorney, Agent, or Firm*—Gregory J. Nelson

[57] ABSTRACT

A slitter/rewinder machine for processing web material such as label stock into a plurality of narrower widths. The web from the feed roll is pulled through the machine by the powered rewind arbor shafts. The machine includes various processing stations including an inspection station, splice table, a web guide, web clamp and a slitter station. The slitter station has nip rollers which are rotated by the passing web and which rollers, in turn, power the knife shafts which carry adjustable slitting blades. Constant web tension is controlled at the unwind station by a "dancer" which maintains proper pressure on a brake.

13 Claims, 5 Drawing Sheets

FIG. 1
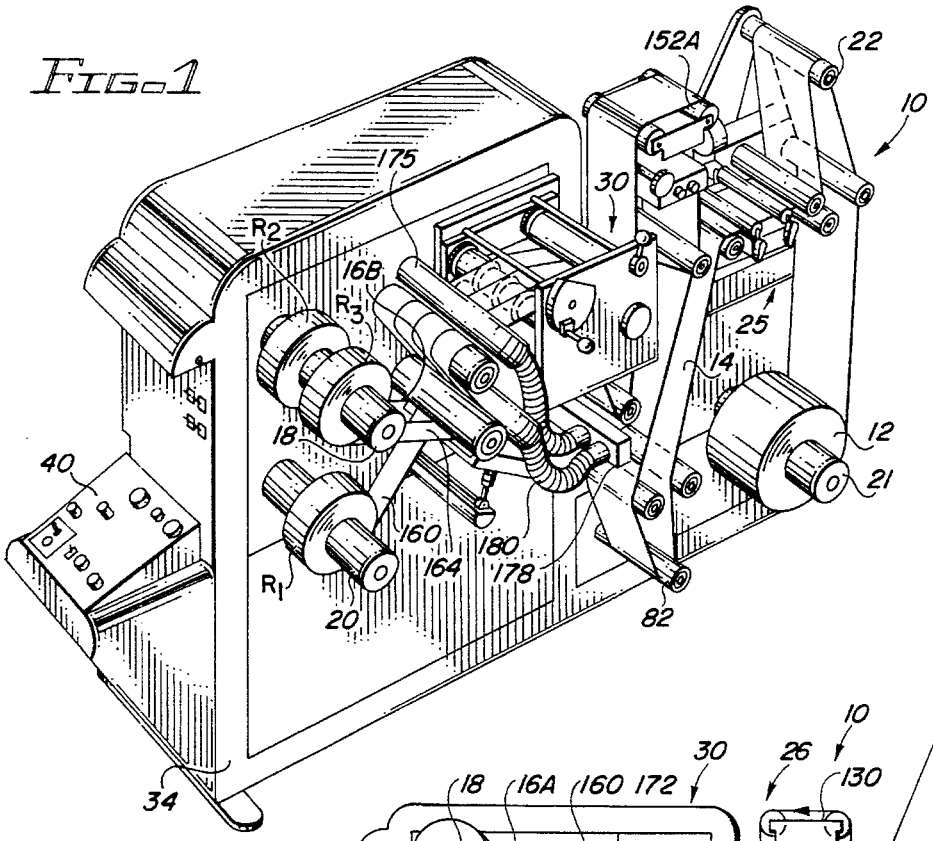
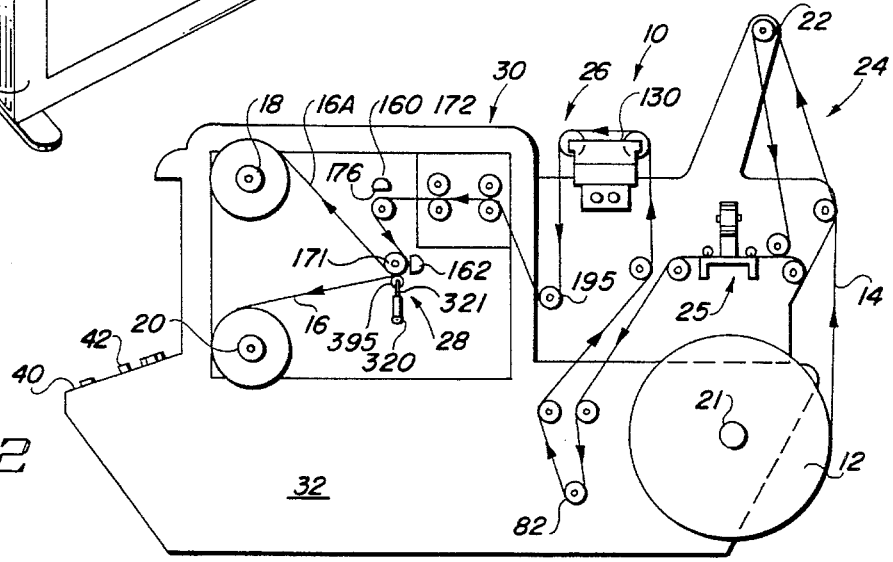
FIG. 2
FIG. 7
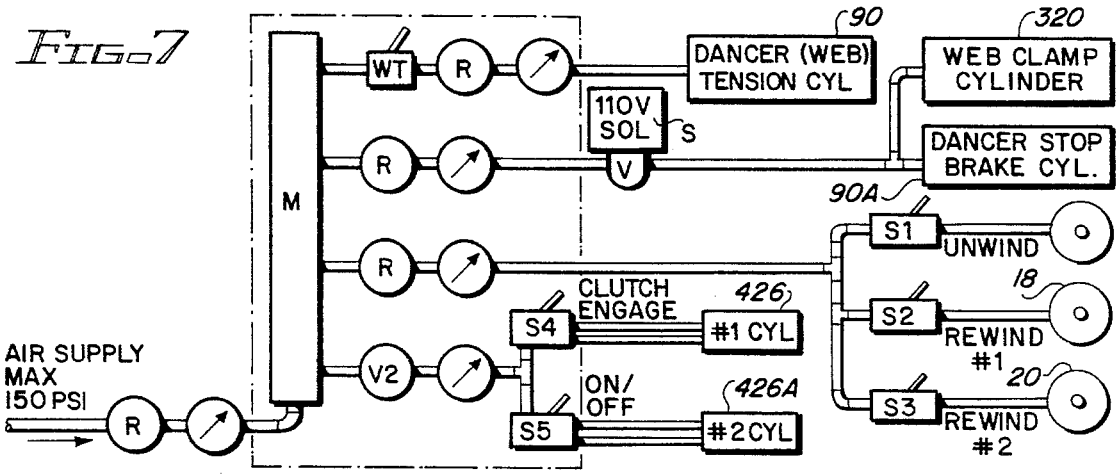

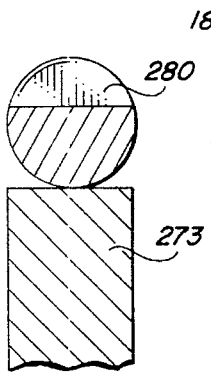
FIG. 5F
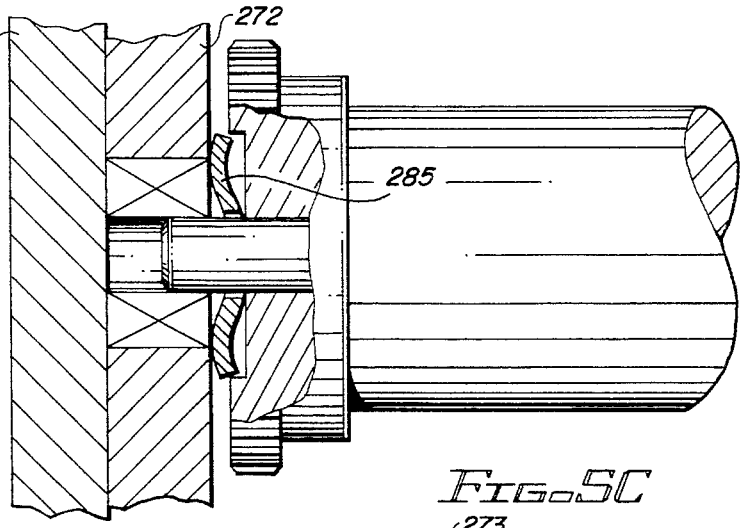
FIG. 5C
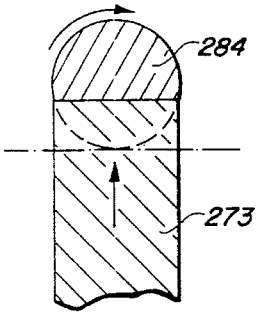
FIG. 5G
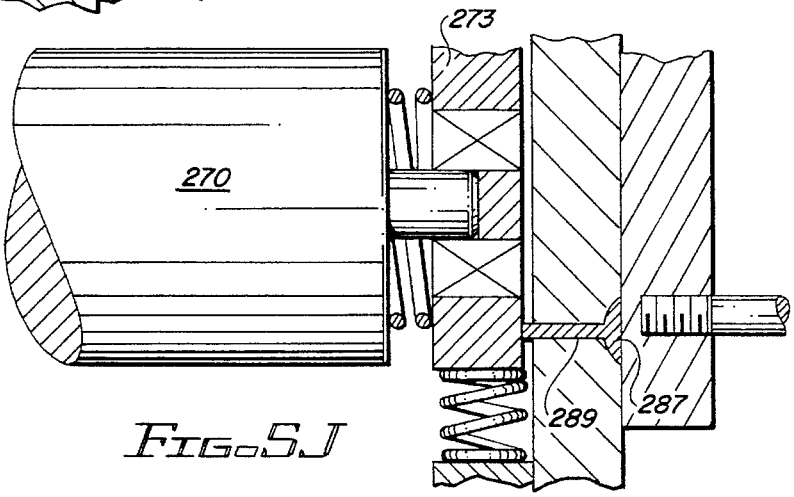
FIG. 5J
FIG. 5A
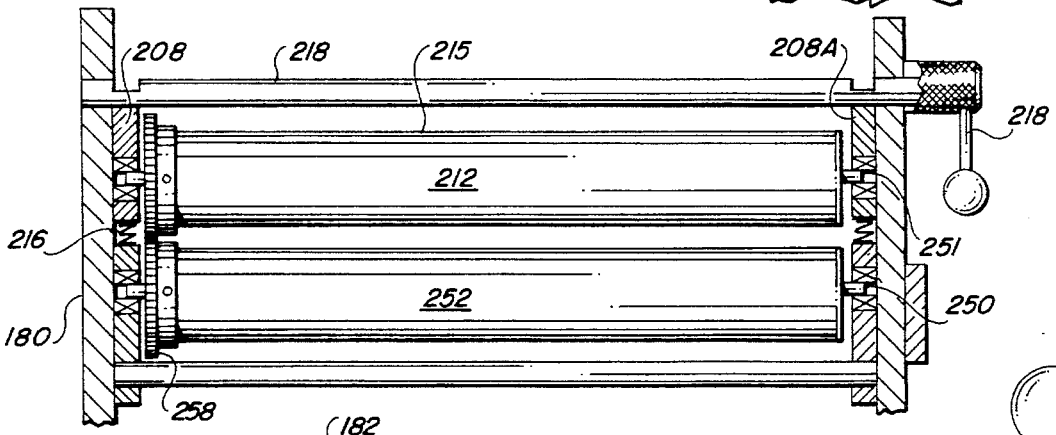
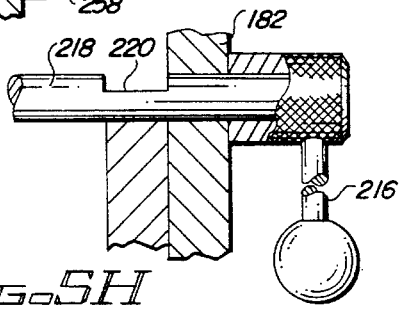
FIG. 5H
FIG. 5I
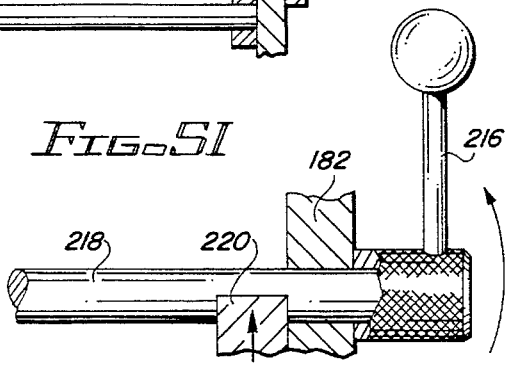

SLITTER/REWINDER MACHINE

FIELD OF THE INVENTION

The present invention relates to machines of the type utilized in the graphics and printing industry for cutting and reclining web roll stock which machines are conventionally known as slitters/rewinders.

BACKGROUND OF THE INVENTION

In the printing and graphics industry, webs of various types such as plastic films, paper, foil, cloth-backed tapes and label stock are prodded as roll-fed stock. It is common practice to unwind the web and slit or sever the web longitudinally into a plurality of webs of reduced or narrower width. The plurality of narrower webs are then re-wound on individual rolls which are provided to the user. The type of equipment used for this purpose are conventionally designated "slitters/rewinders" and various such deuces are on the market for converting almost any type of tape, label stock or flexible web material into narrower rolls. Typical of these types of devices are the slitter/rewinder devices manufactured by the Flexo-Printing Corporation of St. Paul, Minn. designated as Models R150, RT50, T301 and T302Another type of slitter/rewinder is designated the PIC Rewider Slitter and Label Inspector and is manufactured by PIC Industries of Fullerton, CA. Graphic Machine Ltd. of United Kingdom manufactures a slitter/rewinder designated the Omega 330 which is fitted with automatic tension control and a splicing table and includes an electronic web guidance system. Another conventional machine of this type is manufactured by Rotoflex Intl. which has electronic controls, provides a visual inspection station and facilitates various slitting and cutting methods such as scoring, shearing, razor cutting or die cutting.

While the foregoing devices are representative of slitters/rewinders currently available in the art, there nevertheless exists a need for an improved slitter/rewinder which is simple to operate, convenient to maintain and which is reliable and dependable.

SUMMARY OF THE INVENTION

Briefly, the present invention provides a slitter/rewinder having a shaft mounted unwind arbor which receives a feed roll of web stock and several shaft mounted rewind arbors which are powered or driven. The web from the feed roll is pulled by the driven rewind arbors past a number of processing stations which stations include an elevated inspection tower, a splice table, a tension control dancer, a web guide, web clamp and a slitter station having a pair of nip rollers. The nip rollers at the slitter station are not directly powered but instead are driven as a result of the web passing between them. The nip rollers, through an idler gear, drive a shaft carrying one or more rotary slitter knives which knives are axially adjustable on the shaft to establish the width of the severed webs. A sensor on one of the nip rollers counts revolutions and provides information to an indicator such as a digital counter to provide the operator an indication of the length of the web that has been processed.

The rewind arbor shafts of the slitter/rewinder of the present invention are belt driven by a d.c. motor which provides quiet and reliable operation as well as precise speed control. Web tension is established at the unwind station through a "dancer" which applies the correct pressure on a brake to maintain a constant web pressure. In the event the drive motor is shut down and increased braking pressure is necessary, a cylinder at the unwind station automatically applies more braking pressure to stop the unwind shaft.

The device of the present invention is provided with an automatic web clamp and adjustable splice table with a tape dispenser. The inspection tower provides the operator the opportunity to visually inspect the moving web.

Accordingly, it is a primary object of the present invention to provide an improved slitter/rewinder machine for web materials provided in roll form which device is simple to operate and easy to maintain.

It is another object of the present invention to provide a web slitter/rewinder machine which controls acceleration and deceleration of the web and also maintains a constant predetermined web tension.

It is still another object of the present invention to provide a compact slitter/rewinder machine which eliminates many of the mechanical components present in prior art devices which renders them more complex, less reliable and harder to service and maintain.

It is a specific object to provide a slitter/rewinder machine which has belt driven rewind arbor shaft and which utilizes the moving web to power the rotary slitting knives.

BRIEF DESCRIPTION OF THE DRAWINGS

The above and other objects and advantages of the present invention will become more apparent from the following description, claims and drawings in which:

FIG. 1 is a perspective view of the slitter/rewinder machine of the present invention;

FIG. 2 is a schematic view showing the path of the web through the various stations of the machine shown in FIG. 1;

FIG. 5A is a sectional view taken along line 5A—5A of FIG. 5;

FIG. 5C is a detail view as indicated in FIG. 5B;

FIG. 5F is a sectional view taken along line 5F—5F of FIG. 5D;

FIG. 5G is a sectional view taken along line 5G—5G of FIG. 5E;

FIG. 5H is a detail view as indicated in FIG. 5A;

FIG. 5I is a view similar to 5H showing the open position of the nip rollers;

FIG. 5J is a detail view as indicated in FIG. 5B;

FIG. 7 is a schematic diagram of the pneumatic control system; and

DESCRIPTION OF THE PREFERRED EMBODIMENT

Figure 3:
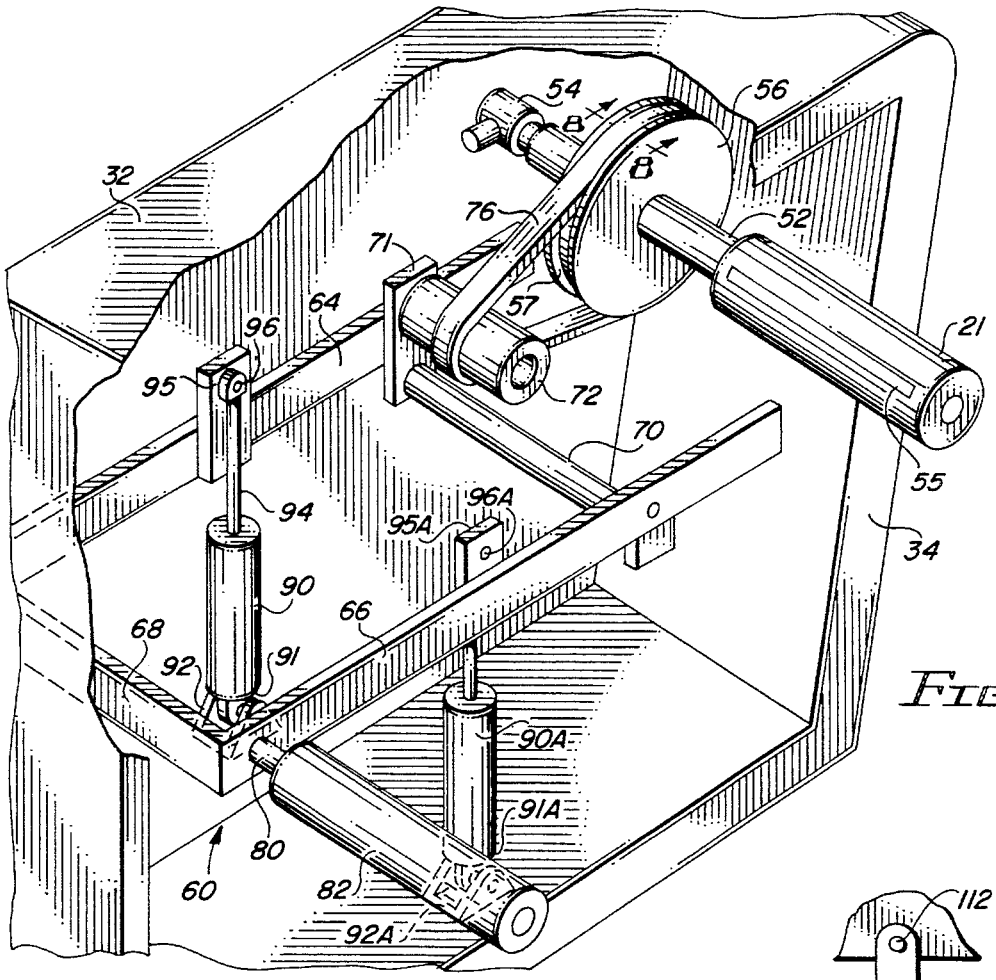
FIG. 3 is a perspective view of the unwind assembly section of the machine with the housing partly broken away to better illustrate the components.

Turning now to the drawings, the slitter/rewinder machine of the present invention is generally designated by the numeral 10 and as seen in FIGS. 1 and is adapted for receiving a large roll of roll stock 12 having a web of flexible material 14 which web when processed through the machine is longitudinally severed into a plurality of narrower webs or strips 16, 16A & 16B which webs are rewound on the rewind rolls positioned on the upper and lower rewind arbors 18 and 20, respectively. The roll stock material 12 may be selected from various types of material such as film, paper, foil, or tapes which are converted into a plurality of web rolls of reduced width. Label stock is a typical example and for purposes of description throughout the web may be referred to as label stock, it being understood the web may be any flexible type of material. In the case of label stock, the label may be printed on a substrate, or a plurality of removable or peelable labels are arranged transversely across the substrate. The substrate containing the labels is converted on the slitter and rewinder machine 10 to provide a plurality of rolls $R_1$, $R_2$ and $R_3$, each containing a web having a single label width.

As seen in FIGS. 1 and 2, the slitter/rewinder machine 10 sequentially performs a plurality of operations at a number of stations and an initial brief summary of the operations carried out at the various stations will aid in understanding the invention. The feed roll 12 is placed on an unwind arbor 21 at the rear of the machine. The web to be converted into multiple webs travels as it is pulled by the driven rewind arbors 18 and 20 across roller 22 at an elevated inspection station 24. From there the web travels across splice table 25. Tension of the web is controlled at the unwind arbor by tension control device 60 which positions the dancer roller 82. The lateral position of the web along its path is established by the web guide 26. One or more longitudinal slits or cuts are made in the web at the slitting station 30 thereby forming a plurality of webs. For purposes of illustration, the web is shown as being slit into three narrower webs 16, 16A and 16B. Web 16 is rewound on roll $R_1$, web 16A on roll $R_3$ and web 16B on lower roll $R_2$. A web clamp 28 is actuated when the machine stops and has a roller engaging the web to prevent slippage of the web.

The slitter/rewinder machine is enclosed in a housing or enclosure 32 which may be of any suitable configuration. The housing has a frame 34 which supports the housing 32. Preferably the housing or enclosure 32 is welded from suitable gauge sheet steel and, as is conventional, is provided with inspection panels provided at convenient locations for servicing and maintenance of the enclosed equipment. A control panel 40 is located at the front end of the machine and displays operator controls 42 for the electrical and pneumatic components. For reference, the "front" of the machine is the area in which the control panel is located and is at the left of the machine as viewed in FIG. 1.

Turning now to a discussion of the various operational stations, web tension of the roll stock is controlled at the unwind arbor 21 by an unwind assembly located at the rear of the machine housing 32. The unwind assembly is best shown in FIG. 3 and includes a transversely extending unwind shaft 52 which may be suitably journaled in low-friction bearing assemblies 54 secured to the housing interior or the frame 34. The outer or distal end of the unwind shaft 52 carries the unwind arbor 21 which receives the core of the roll stock to be processed. The arbor, sometimes known as a core holder, is preferably of the mandrel type which has a plurality of axial bars 55 which are either mechanically or pneumatically radially expandable to engage and disengage the core of the roll stock. Expandable mandrels of this type are well known in the art and those manufactured by Deubhn Company are representative. Reference is also made to U.S. Pat. No. 3,592,405 which shows a mandrel of this type.

Figure 8:
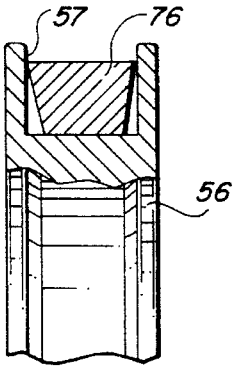
FIG. 8 is a sectional view of a pulley taken along line 8—8 of FIG. 3.

An unwind pulley 56 is secured to the unwind shaft 52 at an intermediate location within the housing. As seen in FIG. 8, the pulley has a peripheral groove 57 which is U-shaped to accept a V-belt to minimize frictional engagement along the side walls of the groove 57.

A dancer frame 60 has a pair of horizontally spaced-apart arms 64, 66 which are interconnected at one end by transversely extending member 68. The arms and the transversely extending member form the dancer frame 60 which is pivotally connected within the housing 32 by transverse pivot shaft 70. A bar 71 is secured to frame arm 64 extending upwardly above the transverse pivot shaft 70. Brake drum 72, which is shown as being generally cylindrical, extends from bar 71 generally co-axial with and spaced above shaft 70. The cylindrical brake drum may be of any suitable heat dissipating material such as cast iron. A brake belt 76 extends around the brake drum and about the groove 57 of the pulley 56. The belt 76 preferably has a V-belt cross section as indicated above.

The dancer frame 60 pivots or rocks about shaft 70 and carries a cantilever shaft 80 which is co-axial with arbor shaft 54 and located at an elevation below and spaced forwardly from the arbor shaft. Shaft 80 is provided with a concentric tensioning roller 82 which is rotatable about the shaft. The roller serves as a "dancer" and engages the web to control tension as will be more fully explained hereafter.

The position of the roller 82 which controls the web tension is established by the dancer frame 60 which is operatively controlled by first and second cylinders 90 and 90A, which are shown as being pneumatic but which may also be hydraulically operated. Tensioning cylinder 90 is mounted in a vertical position having the lower end of the cylinder housing 91 secured to clevis 92. The upper end of rod 94 is pivotally connected to the inner side of arm 64 at block 95 by pivot connection 96. Stop cylinder 90A is similarly positioned having the lower end of the cylinder housing 91A connected to clevis 92A. The upper end of the cylinder rod is pivotally connected to block 95A at pivot connection 96A.

The tensioning cylinder 90 through rod 94 exerts a downward force on the dancer frame which causes the brake drum 72 to apply braking force to the belt 76 and the pulley 56. As indicated in FIG. 7, tension is controlled by air switch WT at the control console 40 which controls the positioning of cylinder 90A. An increase in the air pressure in the air cylinder from manifold M will cause the brake belt 76 to tighten as the rod retracts. Once a predetermined brake pressure has been set, the dancer roller 82 will constantly readjust the braking force so that the web remains at constant tension as the roll size diminishes.

The stop cylinder 90A also exerts a downward force on the dancer frame which will increase braking pressure on the brake drum. In normal operation, cylinder 90A is not actuated until the device is shut down. The primary function of cylinder 90A is to brake the web once the machine has been turned off. When the operator shuts off the drive motor, indicated as d.c. motor 315 in FIG. 6, solenoid S, as seen in FIG. 7, will open valve V to direct air to both the brake cylinder 90A and the web clamp cylinder 321. The operation of the web clamp will be explained in greater detail hereafter.

Upon passing the unwind arbor, the web travels vertically and around roller 22 at the inspection station. The vertical section of web approaching roller 22 affords convenient visual inspection by the operator.

Figure 4A:
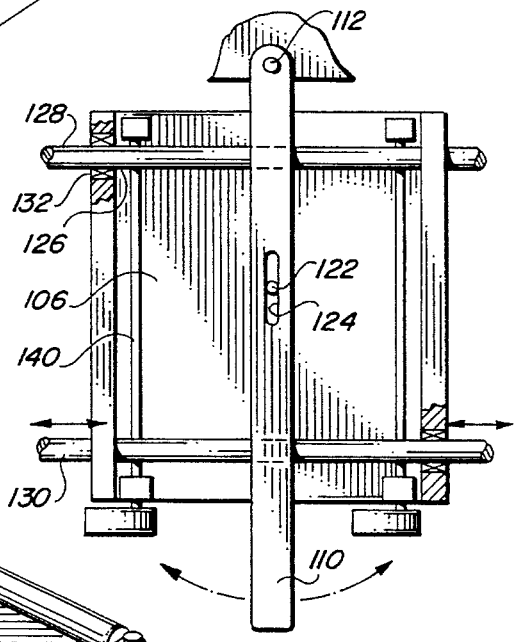
FIG. 4A is a bottom perspective view of the splice table assembly section shown in FIG. 4.
Figure 4:
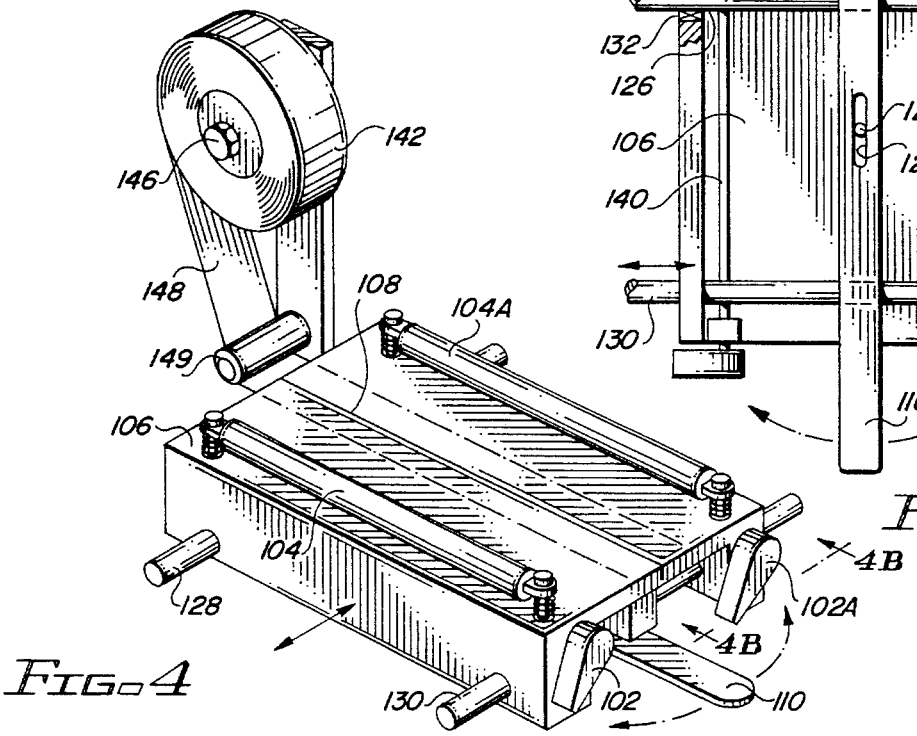
FIG. 4 is a perspective view of the splice table assembly section of the machine.
Figure 4B:
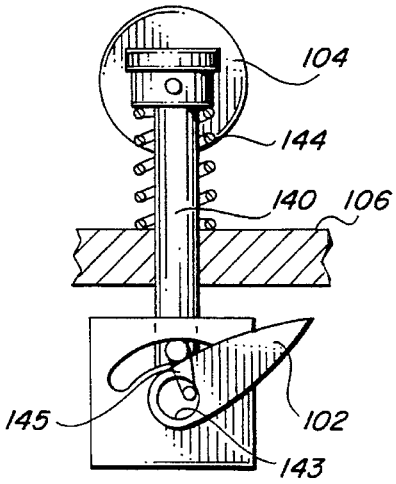
FIG. 4B is a partial sectional view taken along line 4B—4B of FIG. 4.

The splice station 25 is located in the web path between the inspection station 22 and the web guide 26. As best seen in FIGS. 4, 4A and 4B, the splice station is manually operated and includes a table 106 which has levers 102 and 102A which operate the parallel and spaced-apart clamping bars 104 and 104A movably disposed above the horizontal surface of the table 106. A slitting groove 108 extends transversely across the surface of table 106 intermediate the clamping bars.

The table 106 is longitudinal slidable with respect to the web which passes between the clamping bars 104, 104A and the table 106. Table adjusting lever 110 will move or adjust the table in either longitudinal direction as required. Lever 110 is pivoted at its inner end at the housing at 112. A pin 122 depends from the table into slot 124 in the lever. Rods 128 and 130 are fixed and extend through bores 126 at opposite sides 128 of the table. The table is slidable with respect to the rods 128, 130 at journal bearings 132 which are positioned about the rods 128 and 130. Pivotal movement of the outer end of lever 110 will impart movement to the table to properly position the slitting groove 108 so a cut can be made to provide a clean edge for splicing or feeding the web.

The clamping bars 104 and 104A are vertically positioned by handles 102 and 102A. Referring to FIG. 4B which is representative and shows clamping bar 104, each bar is rotatably carried on the upper end of a pair of posts at 140. Springs 144 about the posts bias the clamping bars to an open position. Handles 102 and 102A are disposed on the outer end of the table and are connected to a shaft 143 having a pair of eccentric cranks 145 which are pivotally secured to the lower end of the posts. Rotation of handles 102, 102A imparts rotary motion to shaft 143 which, in turn, exerts a downward pull on both posts via cranks 145. This overcomes the spring biasing force applied by springs 144 and brings the clamping bars into engagement with the upper surface of table 106. Reversing the handles 102, 102A will again open the clamping bars. A tape dispenser 142 is mounted on a dispenser shaft 146 above the splice table and feeds a strip of tape 148 across the surface of the splice table beneath feed roller 149.

In operation, the operator will either manually or by "jogging" the machine, advance the web to the proper position so that in the case of label stock a small gap such as a ⅛" gap between the labels on the web exists approximately aligned with the slitting groove 108 of the splice table. The operator will use the table adjusting lever 110 beneath the splice table to move the splice table so the slitting groove 108 is positioned directly below the web at the point the web is to be cut.

Thereafter, the operator rotates the levers 102 and 102A so that the clamping bars 104 and 104A are pulled down tightly against the web, clamping the web firmly against the splice table 106. Using a suitable razor or other cutting tool, the web is transversely cut using the slitting groove as a guide for the razor. The right-hand lever 102A is released and the web replaced with a new roll. The new web is pulled into position, locked by the clamping bar 104A and cleanly cut. The cleanly cut ends are joined by placing a strip of tape 148 from the tape dispenser roll 149 under the splice. Thereafter the tape is trimmed and the clamping bars released.

In operation, the web undergoing processing continues past the splice table and around the tension control roller 82 to the electronic web guide 26. The web guide may be of various commercial types currently available in the art such as the SR3010 as manufactured by Acuweb. The web guide includes a sensor 130 to sense the web position which sensor may either be an LED or an ultrasonic sensor. Ultrasonic sensors can be used with either opaque or transparent materials while sensors of the LED type are utilized primarily only with opaque materials.

The web guide serves to guide the web to the slitting station so that the web tracks consistently and accurately. The web guide also provides means of adjusting the web as it passes through the slitting station. The web is moved transversely of its path to properly position the web with respect to the slitting station. As seen in FIG. 1, an adjustment knob 131 is provided which upon rotation will, through a rack and pinion, adjust the transverse position of rollers 152 and 152A. For example, turning the adjustment control counterclockwise will cause the web to move away from the operator and toward the machine and turning the adjustment control in the opposite direction will cause the web to move towards the operator. This method allows quick and precise positioning of the web and is known to those in the art.

An optional vacuum system may also be provided to remove residue or chaff that may be present. Accordingly, upper vacuum head 160 and a lower vacuum head 162 are positioned at suitable locations along the path of travel of the web. Preferably the lower vacuum head 162 is positioned adjacent the web as the web passes around roller 171 at the web clamp 28. The upper vacuum head 160 is positioned adjacent the web as the web leaves the slitting station opposite roller 172. The vacuum heads each have a transversely extending housing 175 each having an opening position 176 adjacent the web. The interior of the housing is connected to suitable vacuum manifold 178 by a length of flexible vacuum hose 180. The vacuum manifold is connected to a suitable vacuum motor located within the console so that the debris adhering to the web primarily as a result of the slitting operation, is removed.

Figure 5:
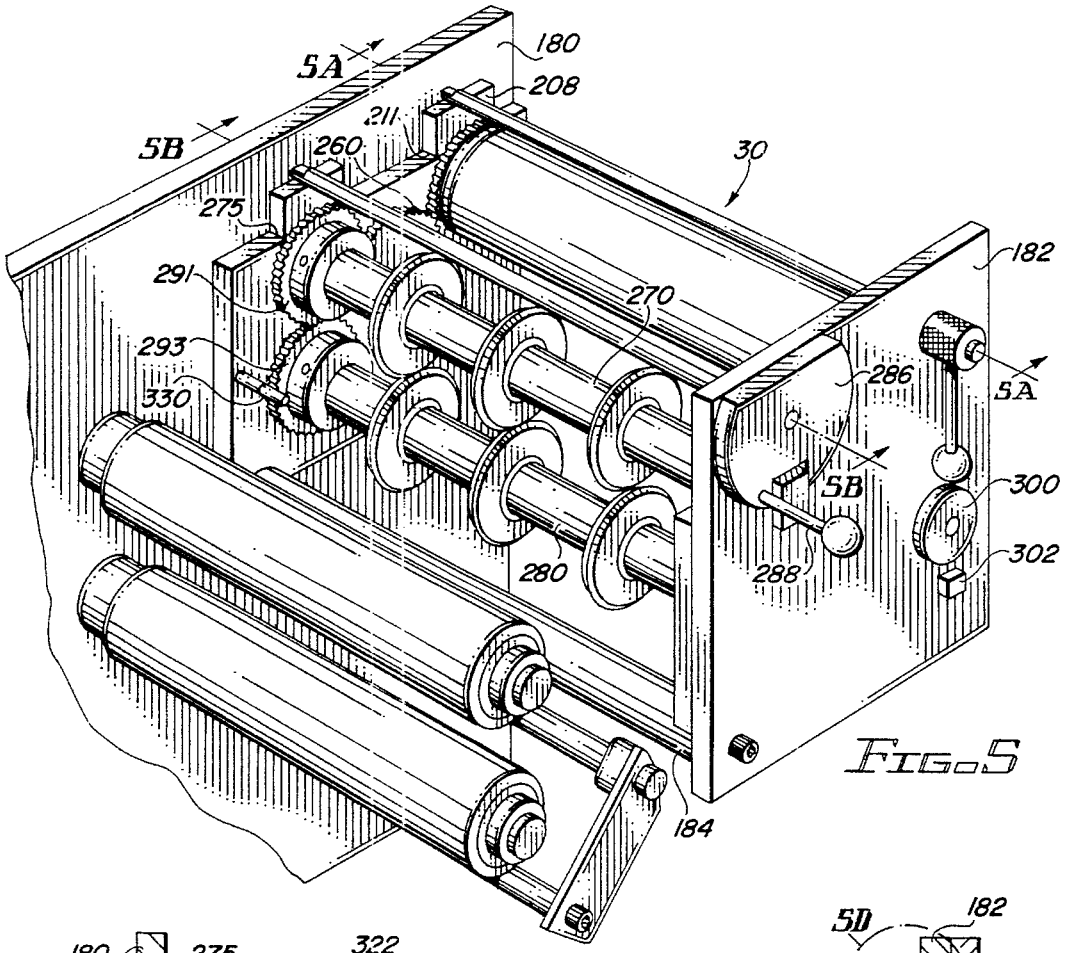
FIG. 5 is a perspective view of the slitter station section of the machine.
Figure 5B:
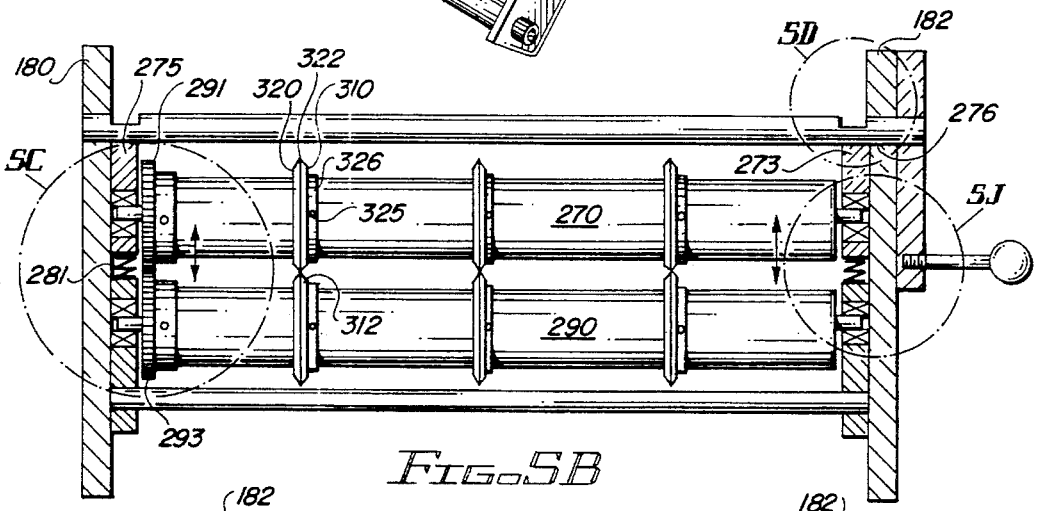
FIG. 5B is a sectional view taken along line 5B —5B of FIG. 5.

The slitting station 30 is best seen in FIGS. 5 through 5J and includes a pair of spaced-apart mounting plates 180 and 182 which are interconnected by one or more transverse bars 184 and form an assembly. As the web leaves the electronic web guide, it travels beneath the roller 195 and enters the slitting station.

At the slitter station, a lower nip roller 252 is rotatable on shaft 250 which is bearing mounted in plates 180 and 182. Shaft 250 may be manually rotated at hand wheel 254 at the exterior of plate 182. The roller surface has suitable frictional characteristics and preferably is rubber. An idler gear 258 is secured to the inner end of the shaft 250.

Upper nip roller 212 extends transversely between fixed plates 180 and 182 and is rotative with shaft 25 1 positioned coaxially above the lower roller 252. The upper nip roller has a roller surface 215 of soft material such as rubber. The opposite ends of the shaft 251 are bearing mounted to gibb plates 208 and 208A which plates are vertically slidable in recesses 211 and 211A, respectively located in the opposite mounting plates. As seen in FIG. 5A, the gibb plates are biased by springs 216 upwardly into engagement with hand wheel shaft 218. During operation of the machine, it is important that the upper nip roller 212 be locked down or engaged against the lower nip roller 252 and this is accomplished by rotating nip engagement lever 216 clockwise which, in turn, causes the shaft 218 to rotate. In the open position shown in FIG. 5I, flattened surfaces 220 located near the ends of the shaft 218 abut both the gibb plates which allows the upper nip roller to move upwardly out of engagement with the lower nip roller 252. In the closed position shown in FIG. 5H, the circular shaft surface is rotated into engagement with the plates to force the gibb plates and the upper roller 212 downward into engagement with the lower roller overcoming the bias of springs 216.

Figure 5D:
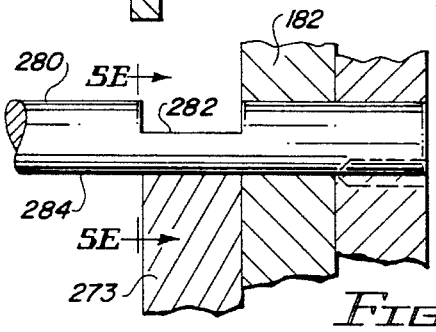
FIG. 5D is a detail view as indicated in FIG. 5B.
Figure 5E:
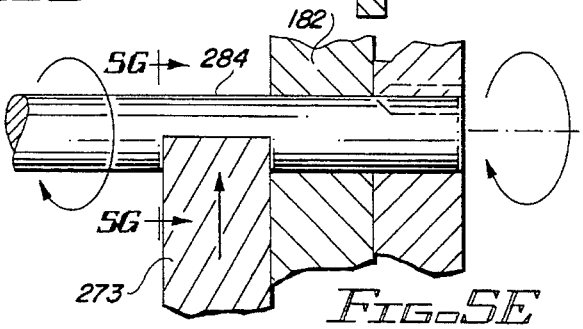
FIG. 5E is a view similar to 5E showing the open position of the knife shafts.

Slitting is accomplished by adjustable knife blades positioned on coaxial knife shafts. An upper knife shaft 270 is mounted horizontally adjacent the upper nip roller 212. The opposite ends of the shaft 270 are bearing mounted on gibb plates 272 and 273. The gibb plates are slidable in recesses 275 and 276 in the mounting plates and are upwardly biased by a spring 281 into engagement with hand wheel shaft 280. As best seen in FIGS. 5D and 5E, shaft 280 has a circular cam surface 284 with notched areas 282 which are aligned with the upper edges of the gibb plates. Rotating the shaft 280 by means of hand wheel 286 through handle 288 to the position shown in FIG. 5D will bring the circular cam surface 284 into engagement with the gibb plates 272 and 273 moving the knife shaft 270 downwardly. Rotation of the hand wheel approximately 180° clockwise to the position shown in FIG. 5E will align the notches 282 with the gibb plates permitting limited upward movement of the plates to allow the rotary knife blades to separate slightly to an "open" position.

Referring to FIG. 5C, shaft 270 is spring biased toward front plate 182 by a wave washer 285 interposed between the inner end of the shaft 270 and the gibb plate 272. Rotation of the hand wheel 286 to the position shown in FIGS. 5D and 5J will bring button-head detent 287 into engagement with a pawl 289 in plate 182 which, in turn, will exert an inward force against the gibb plate 273 and shaft. This will result in the upper knife shaft 270 "closing" or moving downwardly while moving rearwardly at the same time. Rotating the hand wheel 180° to the position shown in FIG. 5E will allow the upper knife shaft and associated knife blades to move upwardly and away from the lower blades to an "open" position.

The lower knife shaft 290 is co-axial with the upper knife shaft. The upper shaft carries a gear 291 at its inner end which when the knife shafts are "closed" engages the gear 293 on the lower knife shaft. The lower nip roller 252 carries a gear 258. Idler gear 260 engages the gears 258 and 293 on the lower nip roller and lower knife shaft respectively.

The movement of the web between the nip rollers imparts rotation to the nip rollers. The lower nip roller, in turn, is geared through the idler gear 260 to the lower knife shaft gear 293 which, in turn, drives the upper knife shaft. Powering the knife shafts from the moving web is in contrast to the conventional machines in which the nip rollers are powered to pull the web to the cutting station. One significant advantage of powering the knife shaft from the moving web is that bunching of the web is avoided.

The shaft of the lower nip roller has a stub shaft extension which carries a disk 300. A sensor 302 is located adjacent the disk 300 and counts the revolutions of the disk and transmits this information to a counter on the console. Typically the counter is programmed to register so that the length of the web which has passed can be read at the console.

The upper rotating knife shaft carries a plurality of rotary knives 310 and the lower knife shaft carries a plurality of knives 312. The rotary shear knives each are shown as having an annular body 320 with a peripheral cutting edge 322. The knives are axially adjustable along their respective upper and lower knife shafts and may be locked at a selected position by means of conventional set screws 325 in hub 326 which are engageable by a tool such as an Allen wrench. The relative positioning of the knives along the respective shafts is determined by the location at which the web is to be slit. Multiple knives may be positioned on the upper and lower knife shafts. The upper and lower knives act in cooperation with one another with the dimensional relationship of the nip rollers and knives selected so the knives run at a slightly greater peripheral speed than the nip rollers.

Projecting from the inside face of plate 180 is a small dowel 330 which is approximately two inches long. The outer end of the dowel serves as an indicator establishing the ideal position of the edge of the web as it passes through the cutting station. For convenience, this dowel is termed a reference dowel and is provided as a convenient point of measurement when adjusting the knife blades.

An automatic web clamp designated by the numeral 28 is located directly below the lower idler roller 171 adjacent the slitting station. The clamp consists of a pneumatic cylinder 320 which has its rod end positioned to engage roller 171 when the rod is extended. The rod end carries a roller 321. When the operator depresses the stop button or when a counter reaches a stop count and automatically shuts the motor off, the solenoid S will open the air valve pressurizing both the dancer brake cylinder 90 and the web clamp cylinder 320 and the web clamp will close with the roller 321 against the idler roller 171. The purpose of pinching or clamping the web to the idler roller is to maintain proper alignment of the web within the rewind arbors. The small roller 321 rotates if the idler roller 171 is rotating as rotation will tend to prevent an undesirable braking action.

The material, once slit, is rewound on rolls on the rewind arbors at rolls R, $R_1$ and $R_2$. The slitter/rewinder machine of the present invention is unique in that it is provided with two rewind arbors 18 and 20 that can be operated independently or in tandem. This operational advantage allows the operator to position the rewind rolls with one or more winding up as shown in FIG. 2 and the other winding in a down position. Some materials can be rewound on a single arbor allowing the operator to rewind one arbor while preparing the second arbor.

The arbor controls are located on the console 40. Referring to FIG. 7, switch S1 controls the arbor inflation of arbor 21 on unwind shaft 52. Switch S2 controls the arbor on upper rewind shaft 18 and S3 controls the arbor on the lower rewind shaft 20. The switches S2 and S3 will cause the arbor bladders to inflate to engage the roll cores. The switches S4 and S5 operate the clutch mechanisms which engage the belt drive powering the rewind arbors as will be explained.

Figure 6:
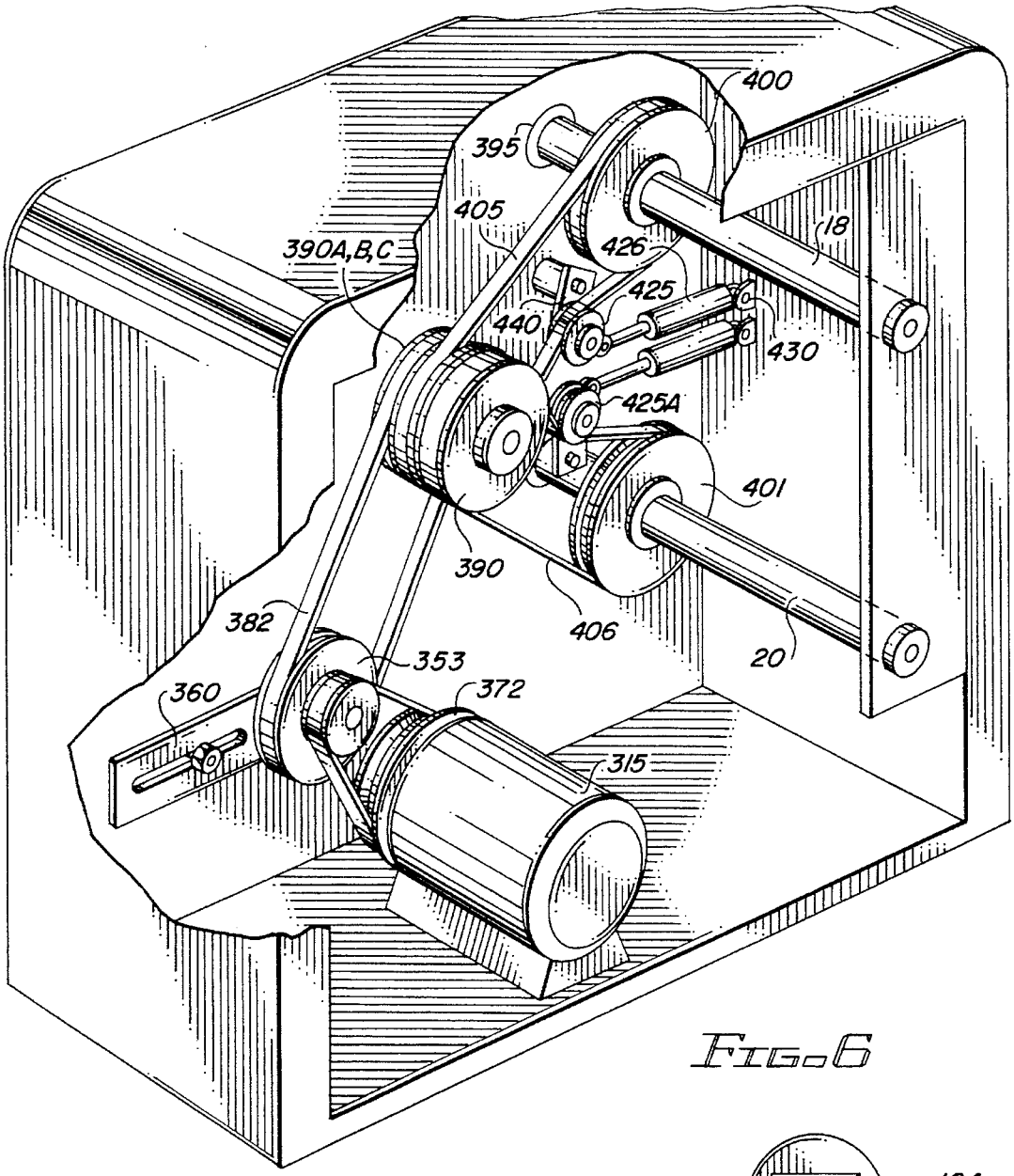
FIG. 6 is a perspective view of the upper and lower rewind assembly with the housing partly broken away.

The rewind shafts 18 and 20 are operated by a drive assembly as shown in FIG. 6 which drive assembly is enclosed in the housing and secured to the frame. FIG. 6 is a view from the rear side with the inspection panel removed for clarity. As seen in FIG. 6, the drive is powered by a variable speed reversible dc motor 315 which for most applications would be a one horse power motor. A rotatable jack shaft assembly 355 is adjustably secured by mounting bracket 360 to the interior of the enclosure. The jack shaft assembly is shown as having a pulley which is stepped having grooves 355A, 355B and 355C of different diameters. The output shaft of the motor 315 is similarly provided with a three-step drive pulley 372 having pulley grooves 372A, 372B and 372C of different diameters. Various pulley combinations of the drive and jack shaft pulleys may be used to achieve different torque and speed ranges. For example, by using the smallest drive pulley diameter and the largest jack shaft pulley diameter, the highest power level is achieved with the slowest speed.

Drive belt 382 extends between the pulley of the jack shaft and the main drive pulley 390 which has three pulley grooves 390A, 390B and 390C. The main drive pulley 390, in turn, drives both the upper rewind shaft 18 and the lower rewind shaft 20. The upper and lower rewind shafts are suitably journaled in bearings 395 and extend transversely within the housing. The upper rewind shaft carries pulley 400 and the lower arbor shaft carries pulley 401. Pulleys 400 and 401 are driven from pulley 390 by belts 405 and 406, respectively, which are shown as V-belts. The pulleys 390, 400 and 401 preferably have U-shaped grooves as seen in FIG. 8 which grooves are designed to cause both the upper and lower pulleys 400 and 401 to rotate at the same r.p.m. under all loading conditions.

Tension on the upper and lower belts 405 and 406 is maintained by idler rollers 425 and 425A that are maintained in engagement with the belts by means of tensioning cylinders 426 and 426A. The housing end of the tensioning cylinders are attached to the housing interior or the frame by a clevis 430. The rod ends of the cylinders 426 and 426A each are pivotally attached to the respective associated pivot plate 440, 440A which carries the idler rollers.

The tensioning cylinders are controlled by valve $V_2$ and switch $S_4$ and $S_5$ as seen in FIG. 7. Releasing the air pressure in the cylinders will loosen the belts and the rewind shafts will cease rotation.

In operation, the slitter/rewinder machine of the present invention provides substantial advantages over prior art devices. The web roll 12 to be converted is placed on the arbor of the unwind assembly and the control valve operated to expand the arbor to engage the core of the roll. The web is fed through the machine as shown in FIG. 2. The shear knife station is adjusted so that the shear knives 310, 312 are axially positioned to provide the proper web width after slitting. The web first passes between the two rubber nip rollers 212, 252 which during operation are locked in the down position. The web is manually advanced through the slitter station and the rotary slitter knives will slit the web. When a leader of the desired length has been slit, the ends of the converted web are attached to the appropriate rewind rolls $R_1$, $R_2$, $R_3$ on the upper and lower rewind shafts 18 and 20. In automatic operation, the drive motor 315 is energized powering the rewind shafts. The appropriate pulley ratio between the jack shaft 353 and the main drive pulley 390 is selected in accordance with the requirements of the operation. Appropriate tension on the webs is maintained by properly positioning the upper and lower tensioning cylinders 426 and 426A by operation of the control valve $V_2$.

As indicated, the web material passes from the roll 12 on the arbor of the unwind shaft past the inspection tower to allow the operator visual inspection of the web. The web then passes to the splice table and around the tension control roller 82 to the electronic web guide and through the slitter station. The web first passes between the nip rollers which causes them to rotate. The nip rollers 212, 252 are geared to the slitting knives to impart rotation to the slitting knives. When the machine is not in use or is idle for a time, it is important to raise the nip rollers to the open position to prevent flat spots from developing on the nip rollers. The rotary knives are opened by rotation of shaft 280 through the handle 288. The rotation of the handle will allow the knife shafts to separate both vertically as well as axially.

Web tension is changed by adjusting the amount of braking pressure exerted on the unwind shaft. The brake belt 76 which extends around the unwind shaft pulley 56 and the brake drum 72 controls the tension. The brake drum is connected to a dancer frame and air cylinder 90A applies predetermined force against the dancer frame which causes the brake belt to tighten against the brake drum. Increasing the pressure in the air cylinder will cause the belt to tighten. The second air cylinder 90 provides additional braking action to stop the web when the stop button has been depressed and the motor shut down.

The splice table is located between the unwind station and the web guide. To use the splice table, the operator jogs the machine either manually or by intermittent operation of the rewind arbors. The web is placed on the splice table and locked in place and a clean cut made along the groove 108 in the splice table. The splice is completed by applying a strip of tape 148 at the splice.

The web clamp assembly 28 is located below the lower idler roller 171. When the stop button is depressed or when the counter reaches the stop count, the web clamp will automatically close against the idler roller. The end of the clamp has a roller 395 which rotates so as not to unnecessarily break the web.

The electronic web guide will serve to properly direct the web into the slitting station so the web will track consistently and accurately. Further, the web guide station provides a means of adjusting the web as it passes through the slitting knives.

The vacuum heads provided at the locations indicated will assist in removing residual material from the slitting operation.

The controls are shown in FIG. 7 and are located at the front of the machine as seen in FIG. 1 for the convenience of the operator.

The belt arrangement used at the rewind and unwind station preferably incorporate pulleys with U-shaped grooves in which a V-belt is positioned. Thus, the minor diameter of the pulleys contact the surface of the V-belt providing uniform rotational speed of the upper and lower rewind shafts.

It will be apparent from the foregoing, the present invention provides a unique slitter/rewinder. It will be obvious to those skilled in the art to make various changes, modifications and alterations to the embodiments disclosed herein. To the extent these various changes, alterations and modifications do not depart from the spirit and scope of the appended claims, they are intended to be encompassed therein.

We claim:

1. A slitter/rewinder machine for longitudinally slitting a roll of web material and converting the web material into a plurality of webs of reduced width, said slitter/rewinder machine comprising:

(a) a first frame;

(b) an unwind station having an unwind shaft rotatably mounted with respect to the first frame and having means for securing a roll of web material to be converted thereon, said unwind shaft further having a pulley secured thereto;

(c) tension control means for maintaining a substantially constant tension on the web, said tension control means including a second frame pivotally mounted with respect to said first frame having a dancer idler thereon engageable with the web, a brake drum carried on said second frame and belt means extending between said brake drum and said pulley;

(d) means for applying a predetermined force to said second frame and to maintain selective contact between said dancer idler and said web;

(e) a slitter station including a pair of coaxial knife shafts extending laterally of said web, adjustable rotary knife blades on said knife shafts selectively positionable on said shaft, said slitter station including a pair of nip rollers disposed adjacent said knife shafts and being rotatively driven by the web passing between the rollers, and wherein at least one of said nip rollers is in driving engagement with at least one of said knife shafts;

(f) a drive train including a motor in driving engagement with a rewind shaft, said rewind shaft having means thereon for detachably securing a rewind roll and further including a drive belt extending about a pulley on said rewind shaft and in driven engagement with said motor; and (g) idler means selectively engageable against said drive belt to maintain predetermined tension thereon.

2. The slitter/rewinder machine of claim 1 wherein said knife shafts are provided with positioning means for moving the rotary knife blades selectively out of or into engagement with one another.

3. The slitter/rewinder machine of claim 2 wherein said nip rollers are provided with a rubber coating.

4. The slitter/rewinder machine of claim 1 wherein said motor is in driving engagement with jack shaft via a belt and wherein said jack shaft is in driving engagement with a main drive pulley via a belt and further including at least two rewind shafts, each rewind shaft having a pulley thereon and wherein each of said pulleys on said rewind shafts is in driven engagement with said main drive pulley via a rewind drive belt.

5. The slitter/rewinder machine of claim 4 wherein each of said rewind drive belts is engaged by an idler pulley operatively connected to a pneumatic cylinder.

6. The slitter/rewinder machine of claim 1 further including a splice table located in the web path, said splice table including a surface and clamping bars associated therewith for selectively securing the web to the surface.

7. The slitter/rewinder machine of claim 6 wherein splice table includes a slitting groove extending in said surface and further including means for dispensing splicing tape.

8. The slitter/rewinder machine of claim 1 further including a web clamp disposed in the web path between the slitting station and the rewind shaft, said web clamp including an idler roller about which the web extends and a clamping roller selectively extendable to engage the web.

9. The slitter/rewinder machine of claim 1 further including web guide means for selectively directing the web to the slitting station and adjusting the lateral position of the web as it passes through the slitting station.

10. The slitter/rewinder machine of claim 1 wherein said unwind and rewind shafts have arbors which include pneumatic means for expanding the arbors to engage the roll core of the web roll.

11. The slitter/rewinder machine of claim 1 wherein said pulley grooves are substantially U-shaped.

12. The slitter/rewinder machine of claim 1 further including counter means registering the length of web passing through the machine.

13. The slitter/rewinder machine of claim 12 further including stop means for shutting off the machine when a predetermined length of web has passed through the counter.

* * * * *